US006869319B2

(12) United States Patent
Yamada et al.

(10) Patent No.: US 6,869,319 B2
(45) Date of Patent: Mar. 22, 2005

(54) MISCONNECTION-PROOF KEY AND CONNECTOR USING THE SAME

(75) Inventors: Akio Yamada, Tokyo (JP); Kazuyuki Ozai, Tokyo (JP); Shinya Ishizuka, Tokyo (JP); Kazuhiro Sato, Tokyo (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 10/699,372

(22) Filed: Oct. 31, 2003

(65) Prior Publication Data

US 2004/0224566 A1 Nov. 11, 2004

(30) Foreign Application Priority Data

May 9, 2003 (JP) ..... 2003-131195

(51) Int. Cl.[7] ..... H01R 13/645
(52) U.S. Cl. ..... 439/681; 439/607
(58) Field of Search ..... 439/677–681, 439/607

(56) References Cited

U.S. PATENT DOCUMENTS 3,287,031 A * 11/1966 Simmons et al. ..... 285/27
3,611,272 A * 10/1971 Fairbairn et al. ..... 439/681
4,345,813 A * 8/1982 Hatch ..... 439/681
4,773,881 A * 9/1988 Adams, III ..... 439/681
4,904,194 A * 2/1990 Kilsdonk et al. ..... 439/101
5,066,250 A * 11/1991 Welsh ..... 439/681
5,178,561 A * 1/1993 Lindeberg et al. ..... 439/571
5,402,320 A * 3/1995 Kielstra et al. ..... 361/796
6,095,870 A * 8/2000 Lee ..... 439/681

* cited by examiner

*Primary Examiner*—Hien Vu
(74) *Attorney, Agent, or Firm*—Baker Botts L.L.P.

(57) ABSTRACT

A misconnection-proof key comprises a substantially L-shaped block made of a hard metal including a short arm and a long arm intersecting with the short arm at right angles thereto. The long arm has at a substantially mid portion on its surface a removal preventing protrusion integrally formed therewith. A plurality of misconnection-proof keys thus constructed are used in a connector including an insulating block having a number of contacts, and a metal shell partly covering the insulating block on the side of contact portions of the contacts. The plurality of misconnection-proof keys are each inserted with the long arm into a slot formed at a predetermined position between the insulating block and the metal shell until the removal preventing protrusion is fitted in a removal preventing recess or aperture formed in the slot so that the short arm of the key extending outwardly of the slot. The connector is prevented from being connected to a wrong or improper connector not having notches corresponding to the outwardly extending short arms of the misconnection-proof keys.

2 Claims, 2 Drawing Sheets

MISCONNECTION-PROOF KEY AND CONNECTOR USING THE SAME

BACKGROUND OF THE INVENTION

The present invention relates to a misconnection-proof key and a connector having a plurality of contacts using a plurality of the misconnection-proof keys for preventing the connector from being connected to an improper mating connector.

To date, attempts have been made to prevent misconnection of connectors. One attempt is to make the front end of the metal shell of a connector in the form of a trapezoid in cross-section instead of a rectangle, thereby preventing the connector positioned upside down from being connected to a mating connector. In order to connect a connector to a predetermined mating connector only, in another attempt, the connector is provided with a U-shaped key of plastics fitted in the predetermined end of the metal shell of the connector, so that the predetermined mating connector can be selected by ascertaining whether the mating connector has a notch at a predetermined position for receiving the U-shaped key.

However, such a U-shaped key of plastics is likely to be broken when strong force is temporarily applied thereonto, and is likely to shift its position when a mating connector is being removed from the connector, whereby its performance for preventing misconnection would be lost. Such a fault would be caused by the fact that the U-shaped key is made of plastics and that it does not have means for anchoring it at its predetermined position.

SUMMARY OF THE INVENTION

It is a first object of the invention to provide an improved misconnection-proof key for preventing a connector from being connected to a wrong or improper mating connector, which is rigid sufficiently to withstand even unexpected external force and has a shape enabling the key to be reliably fixed at a predetermined position and to be easily removable therefrom, if required.

It is a second object of the invention to provide a connector using a plurality of the misconnection-proof keys, which is formed with a plurality of slots into which the proof keys are inserted such that parts of the proof keys extend outwardly, thereby preventing the connector from being connected to a mating connector not having corresponding notches for receiving the outwardly extending parts of the proof keys.

In order to accomplish the first object, a misconnection-proof key according to the invention comprises a substantially L-shaped block made of a hard metal including a short arm and a long arm intersecting therewith at right angles thereto and having at a substantially mid portion on its surface a removal preventing protrusion integrally formed therewith.

In order to achieve the second object, in a connector using a plurality of misconnection-proof keys each comprising a substantially L-shaped block made of a hard metal including a short arm and a long arm intersecting therewith at right angles thereto and having at a substantially mid portion on its surface a removal preventing protrusion integrally formed therewith, the connector according to the invention comprises an insulating block having a number of contacts, and a metal shell partly covering the insulating block on its end where contact portions of said contacts are located, and the connector further comprises a plurality of slots being formed at predetermined positions between said metal shell and said end of the insulating block, and removal preventing means respectively being formed in said plurality of slots such that when said long arms of said misconnection-proof keys are inserted into said slots until the removal preventing protrusions of said keys are fitted in said removal preventing means, respectively, and said short arms of said keys are extending outwardly from said slots, respectively, thereby preventing said connector from being connected to a connector not having notches corresponding to said outwardly extending short arms of said keys.

The expression "a plurality of slots being formed between the metal shell and the end of the insulating block" is herein understood as signifying that the slots may be formed in either, or both, of the metal shell and the insulating block of a connector.

Each of the slots is formed therein with a recess as the removal preventing means into which the removal preventing protrusion of the key is fitted, thereby reliably holding the misconnection-proof key. The misconnection-proof keys can be readily inserted into the slots of the connector, respectively, because of the elasticity of metal shell or insulating block.

In a preferred embodiment of the invention, the removal preventing means are formed as apertures so as to open at the outer surface of the metal shell. With this construction, when the key is removed from the slot of the connector, the removal preventing protrusion exposed in the opening of the removal preventing means is pushed inwardly to disengage the protrusion from the opening, thereby enabling the misconnection-proof key to be removed from the slot of the connector with ease.

The present invention having the features described above can bring about the following significant functions and effects.

(1) The misconnection-proof keys according to the invention are fitted in a connector in a more reliable manner than those of the prior art and can perform the misconnection preventing performance in a reliable manner.

(2) According to the invention, the misconnection-proof keys can be easily removed from the connector. Therefore, by selectively inserting the misconnection-proof keys into the selected slots of connectors, a plurality of different arrangements of misconnection-proof keys for a plurality of connectors are possible.

(3) As the metal shell of a connector is elastic, the misconnection-proof keys can be easily inserted into the slots of the connector so that the removal preventing protrusions of the keys are securely fitted in the removal preventing means of the connector according to the invention.

(4) By selecting the numbers and positions of the slits from those already formed in connectors, combinations of connectors with their mating connectors can be selected at will.

The invention will be more fully understood by referring to the following detailed specification and claims taken in connection with the appended drawings.

DESCRIPTION OF THE PREFERRED EMBODIMENT

Figure 1:
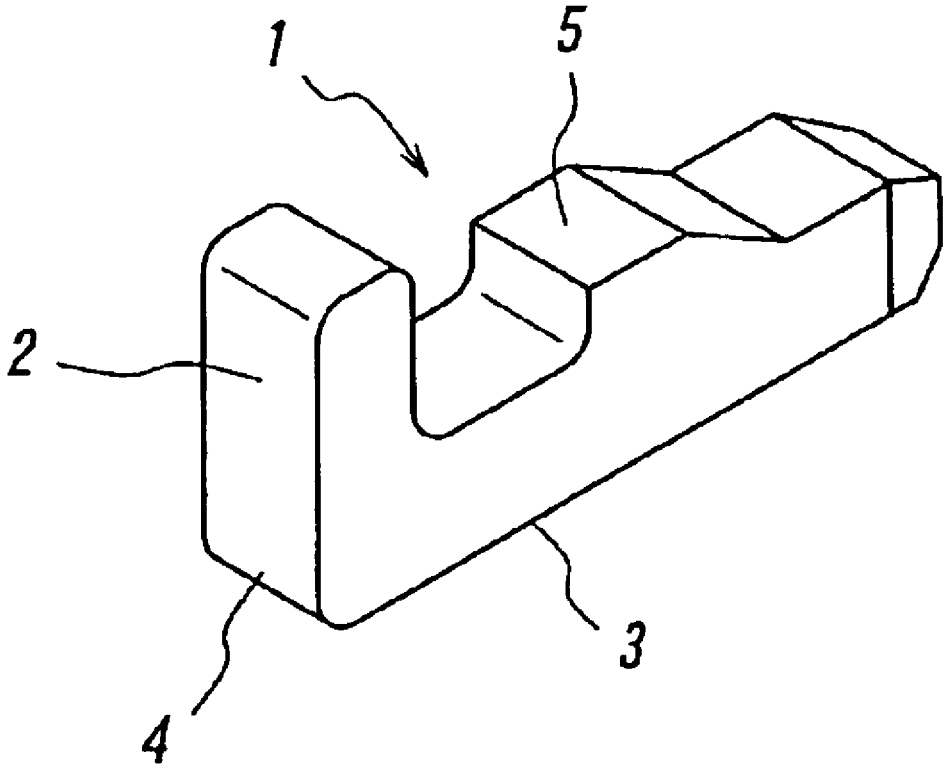
FIG. 1 is a perspective view of a misconnection-proof key according to the invention.

FIG. 1 illustrates in a perspective view a misconnection-proof key 1 according to the present invention. The misconnection-proof key 1 is made of a hard metal such as steel, stainless steel and the like and comprises an L-shaped block 4 including a short arm 2, and a long arm 3 intersecting with the short arm at right angles thereto and formed at a mid portion on one surface with a protrusion 5 integrally therewith for preventing the key from being removed from a connector using the key.

Figure 2:
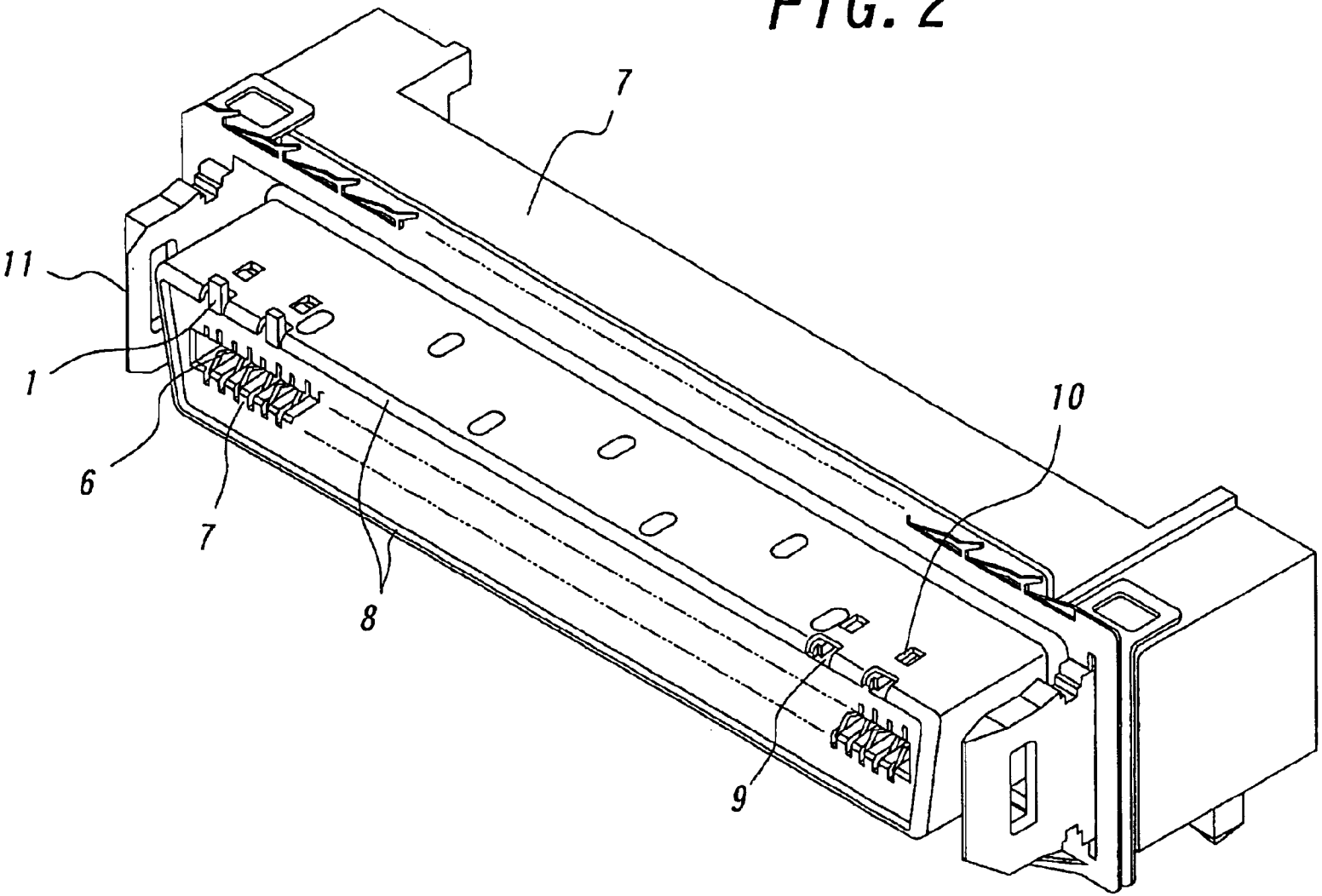
FIG. 2 is a perspective view of a connector using the misconnection-proof keys held in its slots formed between the metal shell and insulating block of the connector.

FIG. 2 illustrates a connector having two misconnection-proof keys 1 inserted therein according to the present invention. The connector comprises a number of contacts 6, an insulating block 7 holding these contacts 6 therein, and a metal shell 8 partly covering the insulating block 7 on the side facing to a mating connector (not shown). In the illustrated embodiment, there are provided four slots 9 formed between the end of the insulating block 7 and the metal shell 8 at four predetermined positions. As previously described, the slots may be formed in either, or both, of the metal shell and the insulating block of the connector. Further, each of the slots 9 is formed midway of it with a removal preventing aperture 10 passing through the metal shell 8 for receiving the removal preventing protrusion 5 of the key 1 to prevent its removal from the connector.

With this construction, the misconnection-proof keys are inserted into the slots 9 such that their removal preventing protrusions 5 are fitted in the removal preventing apertures 10 of the metal shell 8, thereby stably holding the misconnection-proof keys 1 in the slots 9 between the insulating block 7 and the metal shell 8 of the connector.

As described above the removal preventing apertures 10 are formed in the respective slots 9 of the metal shell 8. While the removal preventing apertures 10 are shown as apertures passing through the metal shell 8, it will be apparent that they may be formed as recesses inwardly of the metal shell 8 which do not pass through the metal shell 8. In the case of the apertures 10, when the misconnection-proof key 1 is needed to remove from the connector, the removal preventing protrusion 5 exposed in the removal preventing aperture 10 is pushed inwardly to deform the insulating block 7 so as to disengage the removal preventing protrusion 5 from the removal preventing aperture 10, thereby allowing the misconnection-proof key to be removed from the connector. Reference numeral 11 denotes fixtures for the connector.

As shown in the illustrated embodiment, the four slots 9 are provided in the connector, for example, in the insulating block 7 on its upper side, and, for example, three misconnection-proof keys are inserted into three slots 9 selected from the four slots 9 so that there are four kinds of arrangements of the misconnection-proof keys 1. According to each of the four kinds of the arrangements of the keys 1, positions of notches to be formed at corresponding edge of a mating connector (not shown) may be determined for receiving the short arms 2 extending outwardly from the slots 9. A connector can be prevented from being connected to a wrong or improper mating connector whose notches do not correspond to the short arms 2 of the misconnection-proof keys 1 inserted in the slots 9. In this manner, connections between connectors and mating connectors can be suitably selected by the selective arrangements of the misconnection-proof keys in the slots 9 of the respective connectors.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A misconnection-proof connector comprising a plurality of misconnection-proof keys each having a substantially L-shaped block made of a hard metal including a short arm and a long arm intersecting therewith at right angles thereto and having at a substantially mid portion on its surface a removal-preventing protrusion integrally formed therewith, and said connector comprising an insulating block having a number of contacts, and a metal shell partly covering the insulating block on its end where contact portions of said contacts are located, wherein said connector further comprising a plurality of slots being formed at predetermined positions between said metal shell and said end of the insulating block, and removal-preventing means respectively being formed in said plurality of slot and being openings on an outer surface of said metal shell such that when said long arms of said misconnection-proof keys are inserted into said slots until the removal-preventing protrusions of said keys are fitted in said removal-preventing means, respectively, and said short arms of said keys are extending outwardly from said slots, and said removal-preventing protrusions at said mid portions being exposed from said metal shell repectively, thereby preventing said connector from being connected to a mating connector not having notches corresponding to said outwardly extending short arms of said keys and number of misconnection-proof keys used on the connector is less than the number of said slots so that by selecting inserting positions of the misconnection-proof keys in said slots, a plural number of combination connection for the connectors with the mating connectors to be inserted can be obtained and the number of said combinations can be varied by changing the insertion positions of said misconnection-proof keys.

2. The misconnection-proof connector as set forth in claim 1 wherein said plurality of slots comprises four slots and said plurality of misconnection-proof keys comprises three keys.

* * * * *